US005720211A

United States Patent [19]

Cahan

[11] Patent Number: 5,720,211

[45] Date of Patent: Feb. 24, 1998

[54] KEY BLANKING APPARATUS

[76] Inventor: Leslie L. Cahan, 278 Bloor St. E., Suite #503, Toronto, Ontario, Canada, M4W 3M4

[21] Appl. No.: 680,515

[22] Filed: Jul. 9, 1996

Related U.S. Application Data

[63] Continuation-in-part of Ser. No. 529,317, Sep. 18, 1995, abandoned.

[51] Int. Cl.[6] ..... B26D 7/01

[52] U.S. Cl. ..... 83/452; 83/588; 83/686; 83/917

[58] Field of Search ..... 83/451, 452, 588, 83/685, 686, 917

[56] References Cited

U.S. PATENT DOCUMENTS

| | | | |
|---|---|---|---|
| 1,723,935 | 8/1929 | Henricson . | |
| 2,997,907 | 8/1961 | Constantino . | |
| 3,457,746 | 7/1969 | Glassman | 70/408 |
| 3,526,112 | 9/1970 | Herrington | 70/408 |
| 3,587,260 | 6/1971 | Tajiri | 70/408 |
| 3,620,113 | 11/1971 | Gargrave . | |
| 3,673,902 | 7/1972 | Storbel | 83/685 X |
| 3,729,965 | 5/1973 | Gartner | 70/395 |
| 3,780,550 | 12/1973 | Simorghi | 70/395 |
| 3,797,291 | 3/1974 | Simorghi | 70/408 |
| 3,880,038 | 4/1975 | Mangos | 83/685 |
| 4,292,862 | 10/1981 | Thompson | 83/451 |
| 4,441,391 | 4/1984 | Seaman | 83/165 |
| 4,660,397 | 4/1987 | Girimont | 70/456 B |
| 4,796,750 | 1/1989 | Inghram | 206/37.4 |
| 4,909,054 | 3/1990 | Fox | 70/408 |
| 5,236,430 | 8/1993 | Hitt | 83/452 |

FOREIGN PATENT DOCUMENTS

| | | | |
|---|---|---|---|
| 0039577 | 2/1991 | Japan | 70/456 B |

*Primary Examiner*—Douglas D. Watts
*Attorney, Agent, or Firm*—Tod R. Nissle, P.C.

[57] ABSTRACT

Apparatus is provided for producing from existing keys a set of blanked keys each having a reduced equivalent size head. A carrying case permits ready concealment of the blanked keys on the person.

10 Claims, 7 Drawing Sheets

FIG. 10
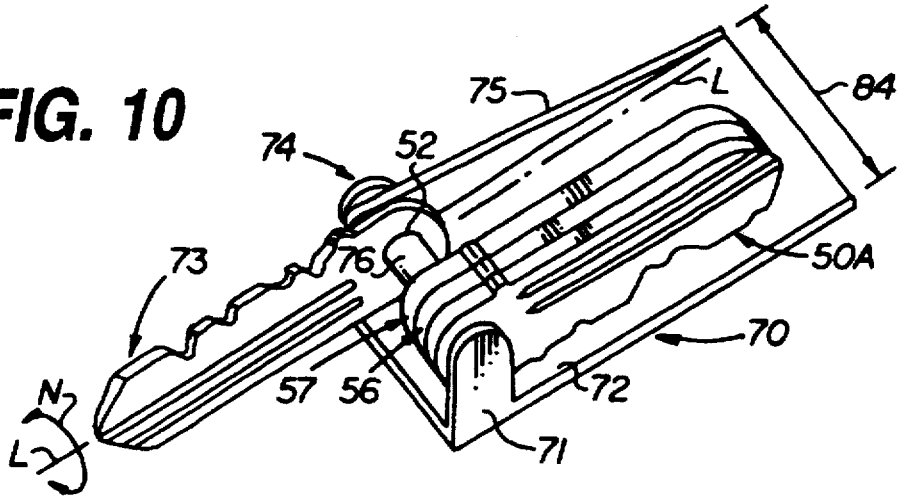
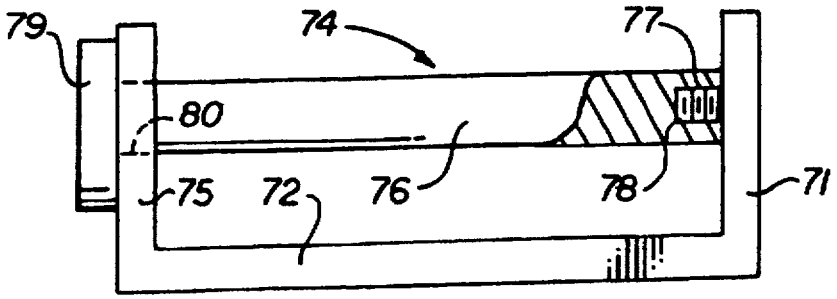
FIG. 11
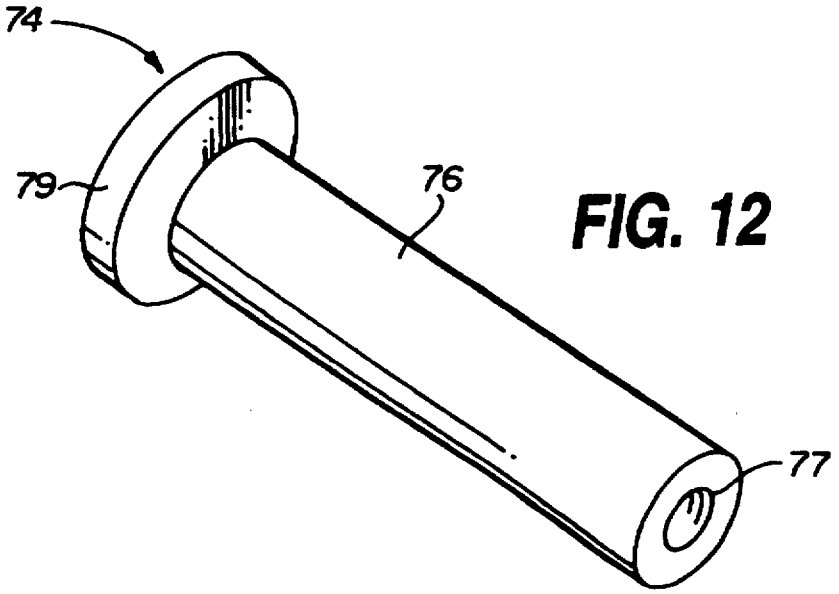
FIG. 12

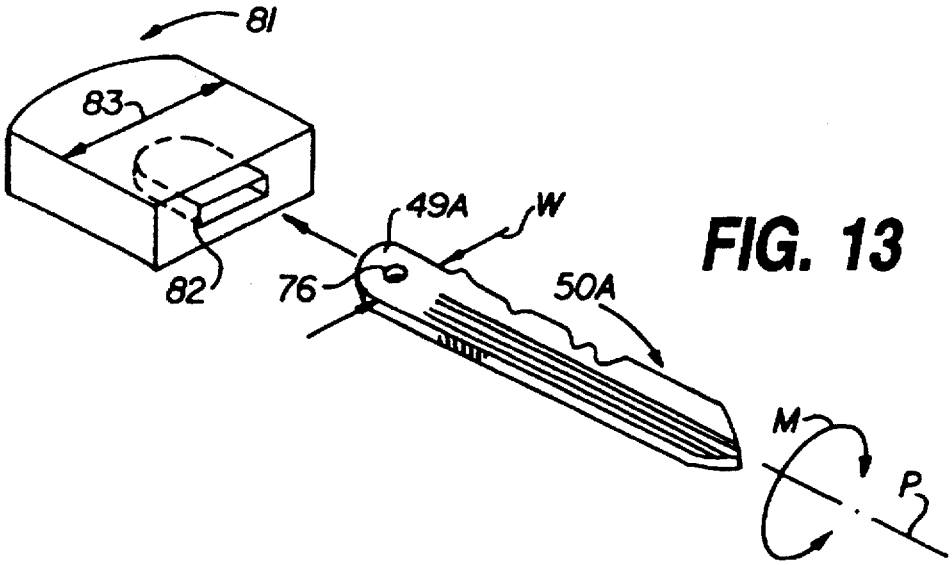
FIG. 13
FIG. 14
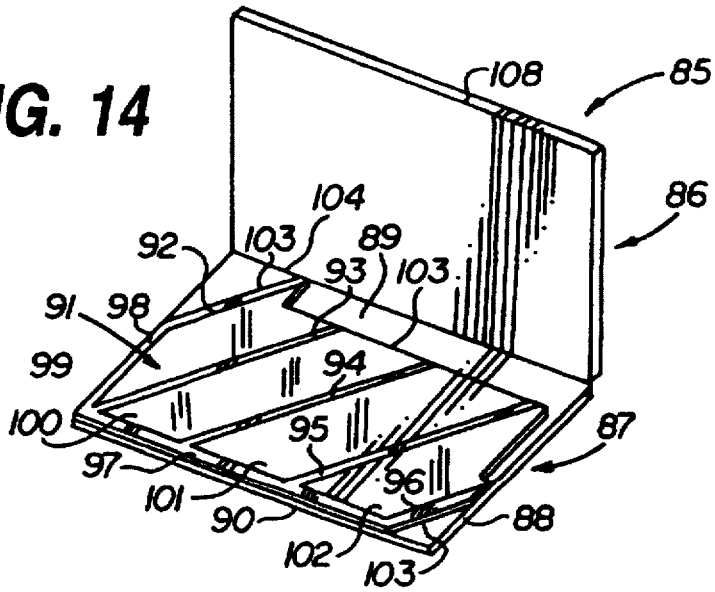
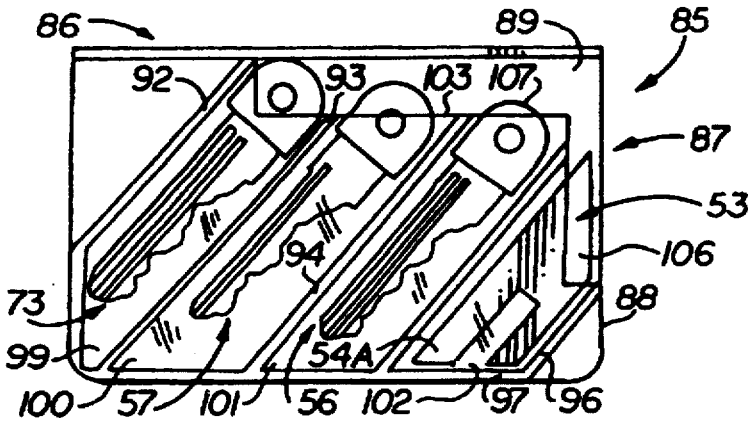
FIG. 15

KEY BLANKING APPARATUS

The present Application is a Continuation-in-part of application Ser. No. 08/529,317 filed Sep. 18, 1995, now abandoned.

This invention relates to a method and apparatus for producing and transporting keys.

The average consumer often carries eight or more keys on a key chain. These keys include automobile keys, keys to the consumer's residence, a key to a bank box, a disable key for a burglar alarm, etc. The large number of keys on an individual's key chain presents a problem in terms of bulk and transportability. The key chain and accompanying keys often will not fit in wallets, pockets, or purses, and the owner of the key chain is therefore more likely to set the keys down at a location separate from the wallet or purse. This increases the likelihood that the key chain will be lost or stolen. Further, the head of each of the keys often has a distinctive shape so that the use of the key is readily identified. For example, keys for a General Motors automobile often have a distinctive oval head. The ability to readily identify the use of a key from the shape of the key head is advantageous to thieves who desire to use the key to quickly misappropriate the property of the true owner of the keys.

Accordingly, it would be highly desirable to provide an improved method and apparatus for opening locks, which apparatus would reduce the bulk of conventional keys and would make it more difficult for a burglar or other thief to determine the use of the keys.

Therefore, it is a principal object of the invention to provide an improved method and apparatus for opening locks.

A further object of the invention is to provide a multiple key set which is readily concealed on the person and reduces the likelihood that the key set cannot be carried in the wallet, purse, or pocket of a user.

Another object of the invention is to provide an improved multiple key set which makes it more difficult for an individual who has misappropriated the key set from its owner to determine the specific use of each key in the set.

These and other, further and more specific objects and advantages of the invention will be apparent to those skilled in the art from the following detailed description thereof, taken in conjunction with the drawings, in which:

FIG. 10 is a perspective view illustrating an alternate embodiment of the invention;

FIG. 11 is an end view of the key holder illustrated in FIG. 10;

FIG. 12 is a perspective view illustrating a component of the key holder of FIGS. 10 and 11;

FIG. 13 is an exploded perspective view illustrating another embodiment of the invention;

FIG. 14 is a perspective view illustrating an emergency carrying case constructed in accordance with still a further embodiment of the invention; and, FIG. 15 is a top view of the carrying case of FIG. 14.

Briefly, in accordance with my invention, I provide improved apparatus for opening at least one lock. The apparatus comprises a pair of blanked keys each formed from a separate existing key. Each of the existing keys opens a lock and includes a head and an elongate neck. The neck has an edge and a tooth pattern formed along said edge. Each of the blanked keys includes a reduced size head formed by removing material from the head of one of the existing keys, and the elongate neck of one of the existing keys. The apparatus also includes a carrier for the blanked keys. Each of the blanked keys can have a head of equivalent size to the heads of the other blanked keys.

In another embodiment of my invention, I provide an improved method for producing from existing keys apparatus for opening at least one lock. Each of the existing keys opens a lock and includes a head, and an elongate neck having an edge and a tooth pattern formed along the edge. The method produces blanks from the existing keys and includes the steps of producing blanked keys by removing material from the head of each of the existing keys to produce a reduced size head; and, mounting the blanked keys on a carrier. The reduced size head of each of the blanked keys has a shape and dimension equivalent to the reduced size head of the other ones of the blanked keys.

In a further embodiment of my invention, I provide improved apparatus for producing blanked keys from existing keys. Each of the existing keys opens a lock and includes a head and an elongate neck having an edge and a tooth pattern formed along said edge. The blanked keys each include a reduced size head formed by removing material from the head of one of the existing keys, and the elongate neck of the one of the existing keys. The apparatus includes shoe means for removably securing one of the existing keys in a selected position; and, means for removing material from the head of the existing keys to form one of the blanked keys while the existing key is in the selected position in the shoe means.

Figure 1:
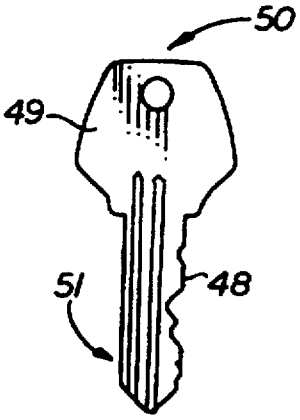
FIG. 1 is a front elevation view illustrating a conventional key having a head and an elongate toothed neck.

Turning now to the drawings, which depict the presently preferred embodiments of the invention for the purpose of illustrating the practice thereof, and not by way of limitation of the scope of the invention, and in which like reference characters refer to corresponding elements throughout the several views, FIG. 1 illustrates an existing key 50 including a head 49 attached to elongate neck 51. A conventional tooth pattern is formed along the edge 48 of the key 50. As is well known, the teeth along edge 48 are sized to turn the tumblers of a lock. As used herein, a key is an instrument, usually small, which includes a head, a neck, an a tooth pattern formed along the neck. As used herein, a lock comprises a device operable at least in part by a key. Consequently, the dead bolt on the door of a building structure which is opened and closed with a key is a lock; the ignition of an automobile which is turned on and off with a key is a lock; the bolt in a chest which is opened and closed with a key is a lock; etc.

Figure 2:
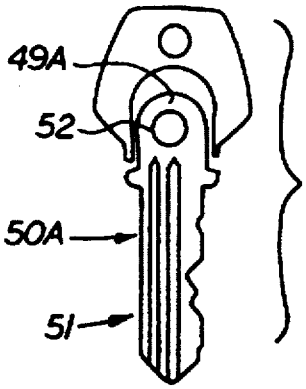
FIG. 2 is a front elevation view illustrating the key of FIG. 1 after it has been blanked to remove material from the head.

In FIG. 2, material has been removed from head 49 of key 50 to produce a blanked key 50A including a reduced size head 49A with aperture 52 formed therethrough. Elongate neck 51 is attached to reduced size head 49A.

Figure 3:
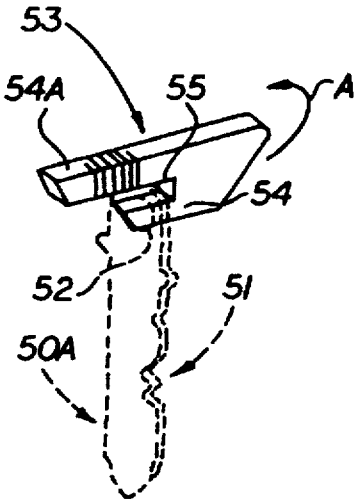
FIG. 3 is a perspective view illustrating the blanked key of FIG. 2 in combination with a removable head which facilitates use of the blanked key.

The rigid head 53 illustrated in FIG. 3 includes finger 54 which is inserted through aperture 52 of blanked key 50A in order to engage key 50A and permit key 50A and head 53 to be simultaneously rotated in the direction of arrow A, or in a direction opposite that of arrow A, when the toothed end of key 50A is inserted in a lock. Finger 54 and aperture 52 are sized such when head 53 is turned in the direction of arrow A in FIG. 3, finger 54 bears against key 50A and causes key 50A to also rotate in the direction of arrow A.

Figure 4:
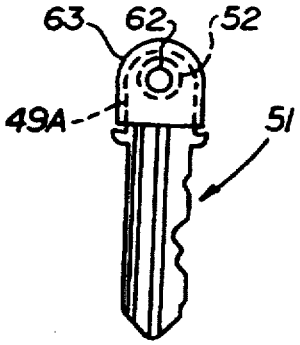
FIG. 4 is a perspective view illustrating the blanked key of FIGS. 2 and 3 after the head of the key has been provided with a plastic sleeve or cover.

In FIG. 4, the head 49A of blanked key 50A is coated with plastic 63. Plastic 63 can adhere to head 49A or can comprise a cap which can be removed from head 49A. The plastic 63 also covers the wall of aperture 52 and forms new aperture 62. Plastic 63 is preferably a selected color. When a plurality of blanked keys are mounted together, it is preferred that the head 49A of each blanked key be color coded. For example, in FIG. 5, the head of key 50A can be red, the head of blanked key 56 green, and the head of blanked key 57 blue. Red can indicate to the user that key 50A is an automobile ignition key. Green can indicate that key 56 is an automobile trunk key. Blue can indicate that key 57 is a front door key. Since the head of each blanked key 50A, 56, 57 is preferably of the same shape and dimension, an individual who is not familiar with the keys and the color coding on the keys cannot detect from the shape of the head of each key 50A, 56, 57 the type of object or lock operated by the key. This discourages theft of the keys.

Figure 5:
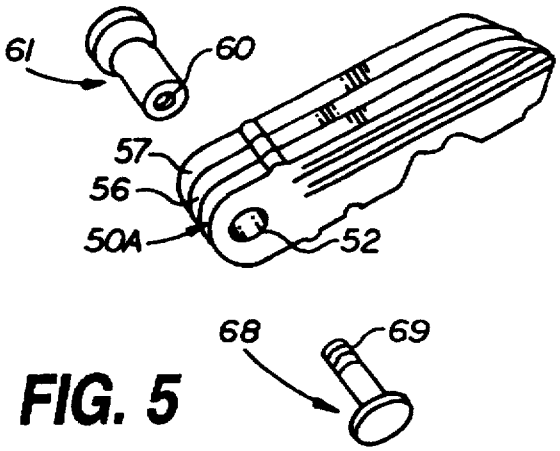
FIG. 5 is an exploded perspective view illustrating a plurality of blanked keys being mounted on a carrier.

In FIG. 5, the externally threaded end 69 of male fastener 68 is slid through the aligned apertures in each of keys 50A, 56, 57 and is turned into the internally threaded aperture 60 of female fasteners 61. After end 69 is threaded into aperture 60 in this manner, keys 50A, 56, 57 are mounted on the carrier comprised of fasteners 61 and 68. A plurality of blanked keys 50A, 56, 57 can be inserted in and transported in any desired carrier. For example, a wallet may function as the carrier and include compartments which permit each key 50A, 56, 57 to be stored in a separate compartment. A key chain can function as a carrier. Head 53 can also, if desired, be stored in a carrier along with blanked keys 50A, 56, 57.

In another embodiment of the male and female fasteners shown in FIG. 5, the male fastener slidably frictionally snaps into the female fastener. When it is desired to remove a key, the male fastener is pulled free, the key is removed, and the male fastener is snapped back into the female fastener. Alternatively, one or more keys can be fixedly secure to the male fastener while other keys are fixedly removably secured to the female fastener. This permits the male fastener to be pulled and slid free from the female fastener to present the male fastener and keys thereon (for example the car keys) to an individual (say a valet parking employee) while the user retains the female fastener and the keys thereon.

Figure 6:
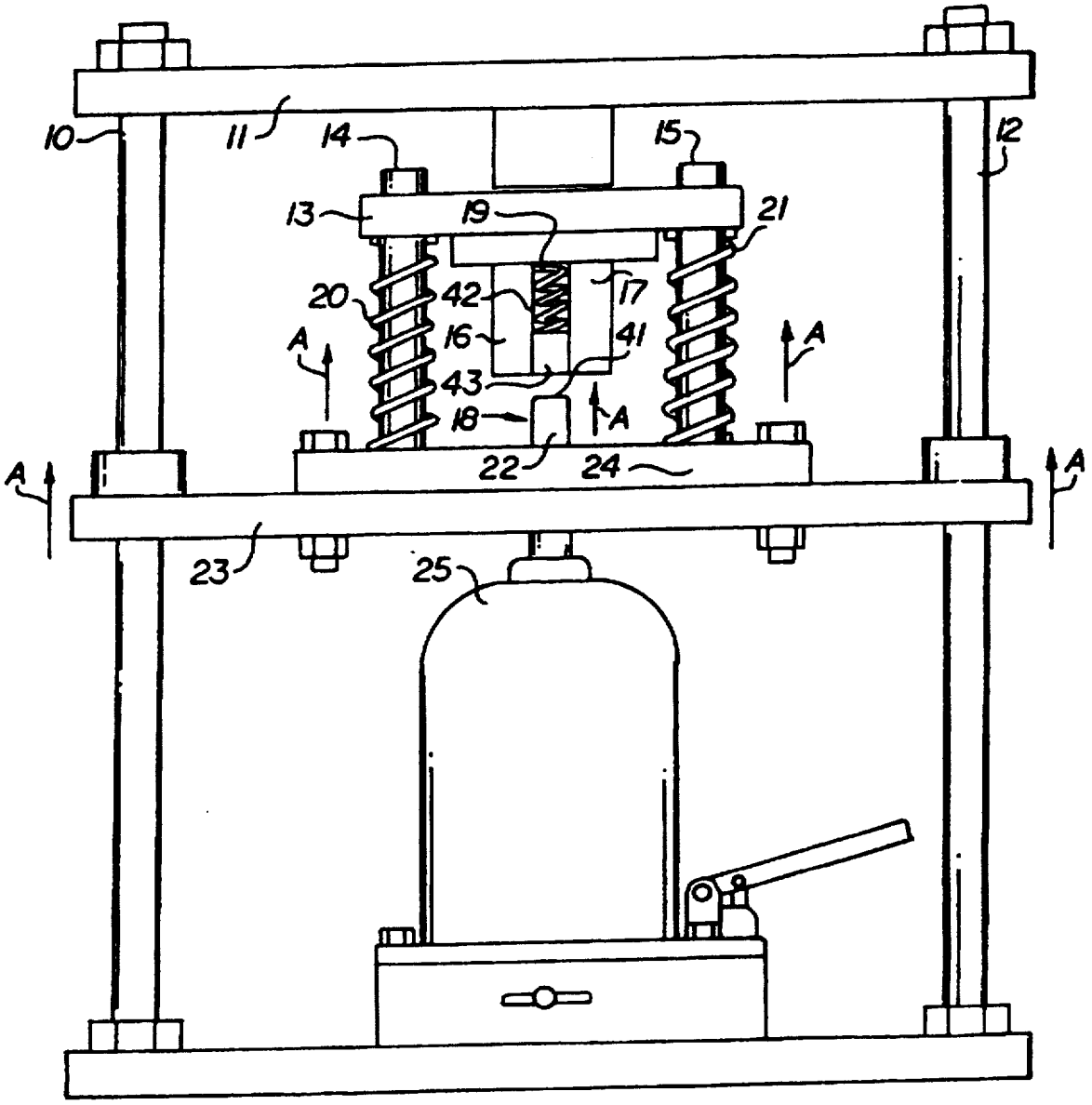
FIG. 6 is a front elevation view illustrating a hydraulic press assembly utilized to blank existing keys in accordance with the method of the invention.
Figure 7:
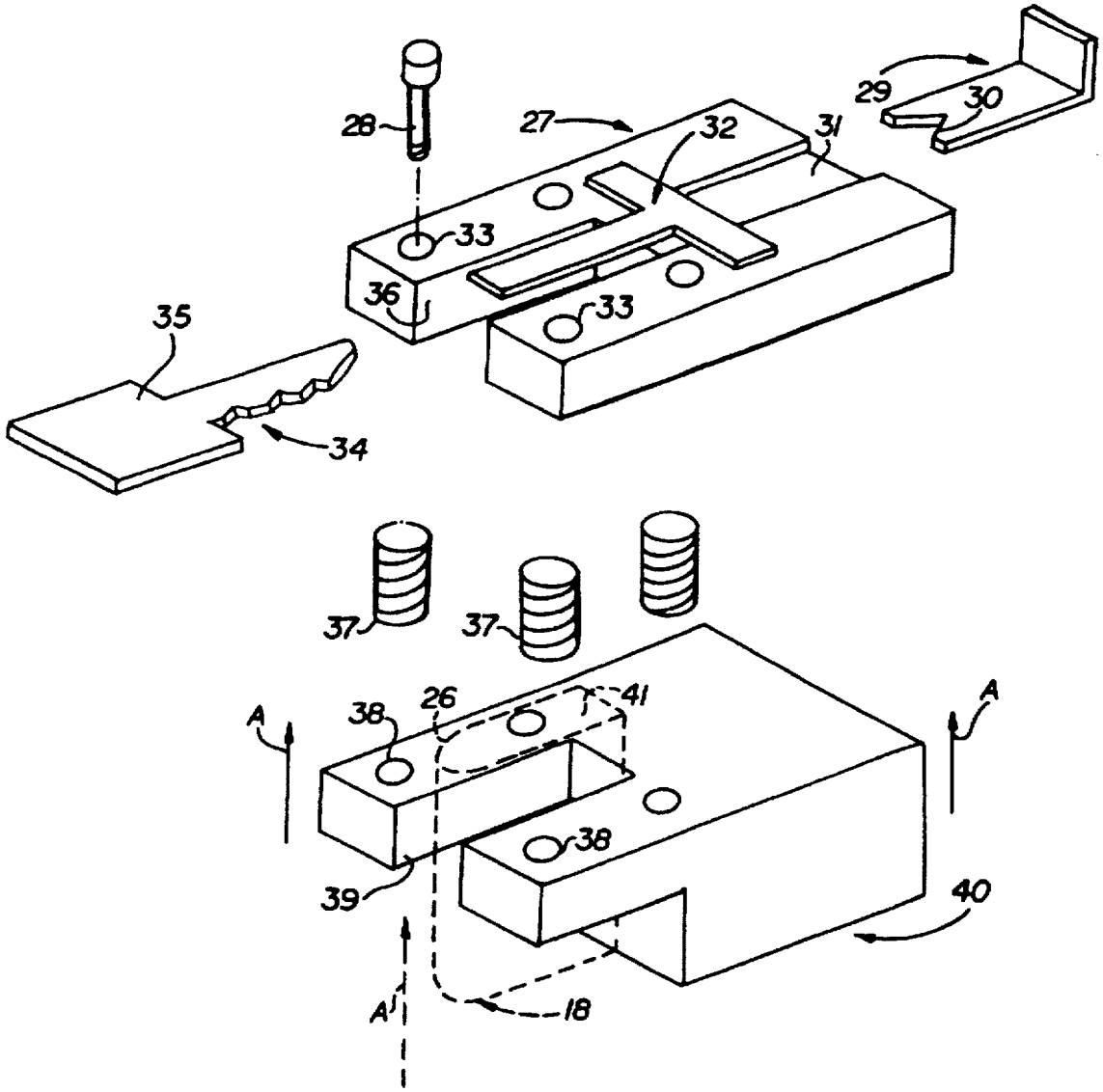
FIG. 7 is an exploded perspective view illustrating a key shoe or positioner which is utilized in combination with the hydraulic press assembly of FIG. 6.

The punching apparatus of the invention utilized to produce blanked keys from existing conventional keys 50 is illustrated in FIGS. 6 to 9. The punching apparatus includes upstanding cylindrical posts 10 and 12 fixedly attached to a rectangular base plate. The upper ends of posts 10 and 12 are fixedly secured to horizontally oriented rectangular plate 11. Horizontally oriented rectangular plate 23 is slidably carried on posts 10, 12 for displacement by hydraulic jack 25 both in the direction of arrows A and in a direction opposite that of arrow A. Rectangular plate 24 is fixedly secured to plate 23. The upper ends of posts 14 and 15 are slidably received by plate 13. Plate 13 is fixedly secured to plate 11. A crown assembly is fixedly secured to and extends downwardly from plate 13. The crown assembly includes a U-shaped die having legs 16 and 17 which partially bound and define a U-shaped opening in the crown assembly. U-shaped member 43 is slidably received by the U-shaped opening in the crown assembly and is attached to spring 19. The upper surface 41 of pedestal 18 is seen in FIG. 7 and has a U-shape. The shape of surface 41 is comparable to the U-shape of member 43 so that surface 41 can contact a key head intermediate surface 41 and member 43, so that surface 41 can upwardly displace the key head and member 43 in the direction of arrow A to compress spring 19, and so that surface 41 and the upper part of pedestal 18 can, after the key head is sheared, slide into the U-shaped opening 42 in the crown assembly. As noted, the upper surface 41 of pedestal 18 contacts the key head 35, presses the key head 35 against member 43 and legs 16 and 17 to shear the key head and form a semi-oval key head, and displaces the semi-oval key head into opening 42. As would be appreciated by those of skill in the art, the resulting semi-oval key head needs to travel only a short distance into opening 42. When the semi-oval key head travels a short distance into opening 42, leg 32A of spring steel member 32 continues to contact the sheared key head, and the semi-oval key head upwardly resiliently pushes and cants spring steel leg 32A a short distance into opening 42 along with the sheared key head. When the hydraulic jack is released, leg 32A' (along with springs 19 to 21) generates a downward force which helps displace plates 23 and 24 downwardly in a direction opposite that of arrow A, and leg 32A resiliently returns or "springs back" to its normal "resting" position illustrated in FIG. 7.

Figure 8:
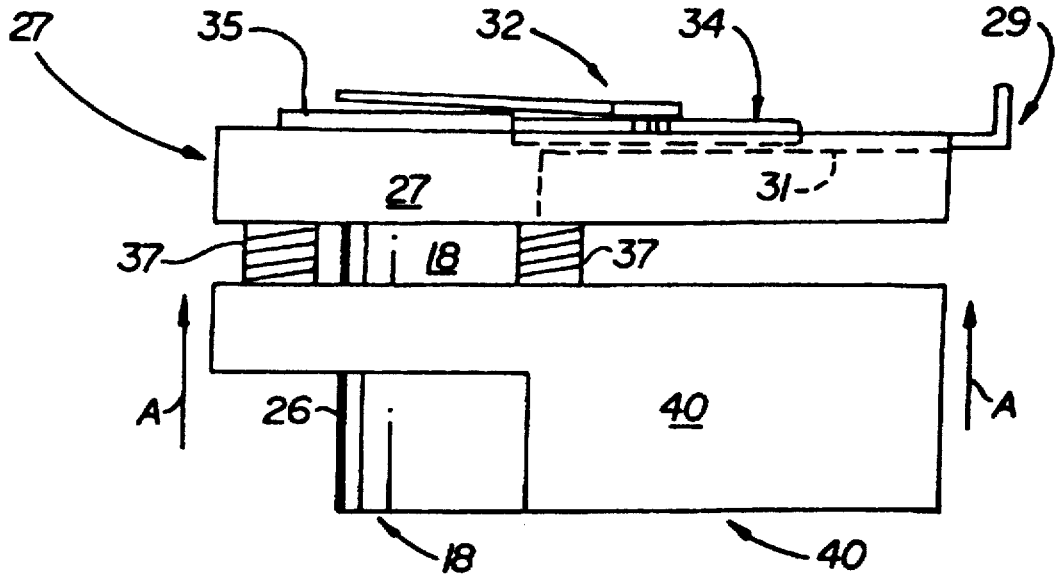
FIG. 8 is a side view of the key positioner of FIG. 7 illustrating the mode of operation thereof.

A shoe assembly or key positioner assembly is illustrated in FIGS. 7 and 8. The shoe assembly functions to maintain a key in the desired position on surface 41 of pedestal 18 while the head of the key is being sheared and trimmed to the desired shape. The shoe assembly, which is not illustrated in FIG. 6 for the sake of clarity, includes upper die 27 and lower die 40. Die 27 has a U-shaped groove 36 formed therein. A plurality of apertures 33 extend through die 27. U-shaped groove 31 in die 27 receive slide 29. Notch 30 in slide 29 contacts the end of a key 34 positioned on die 27 in the manner illustrated in FIG. 8. T-shaped spring steel member 32 is fixedly secured to die 27 and presses a key 34 against the upper surface of die 27 and presses the key 34 into U-shaped slot 31.

Die 40 includes U-shaped groove 39 formed therein. A plurality of internally threaded apertures 38 extend into die 40 and each receive the externally threaded end of a fastener 28. Each fastener extends through an aperture 33, a spring 37, and into an aperture 38. Each spring 37 can slide over the intermediate portion of a fastener 28 and compress and expand when the distance between dies 27 and 40 decreases and then expands during use of the punching apparatus of FIG. 6. FIG. 8 illustrates a side view of dies 27 and 40 after they have been assembled and die 40 has been pushed toward die 27 to compress springs 37. When die 40 moves toward die 27 and compresses springs 37, the heads of fasteners 28 each slide upwardly in an aperture 33. However, each aperture 33 is deep enough so that the heads of fasteners 28 do not protrude or move out of apertures 33 during the displacement of die 40 toward stationary die 27 and during the compression of springs 37 an amount sufficient to shear the head 35 of a key 34.

The lower threaded end of each fastener 28 is fixed in an aperture 38. Consequently, fasteners 28 move simultaneously with die 40.

Prior to using the punching apparatus of FIG. 6 to shear the head of a key, the shoe assembly is placed on plate 24 such that die 40 sets on and contacts plate 24, such that pedestal 18 extends through U-shaped slot 39 in the manner shown in FIG. 7, and such that pedestal 18 extends at least part way into and through U-shaped slot 36. The springs 37 are in their normal uncompressed configuration illustrated in FIG. 7. When jack 25 is operated to upwardly displace plates 23 and 24 (and the shoe assembly) in the direction, of arrow A, die 27 eventually contacts the lower ends of legs 16 and 17 such that U-shaped openings 36, 39, and 42 are aligned and such that movement of die 27 in the direction of arrows A is halted, after which continued movement of plates 23, 24 in the direction of arrow A displaces die 40 toward stationary die 27 and compresses springs 37. The continued movement of die 40 in the direction of arrow A and resultant compression of springs 37 permits pedestal 18 to continue moving in the direction of arrow A, to shear the head of key 35, and to displace the resulting semi-oval key head a short distance into opening 42.

Figure 9:
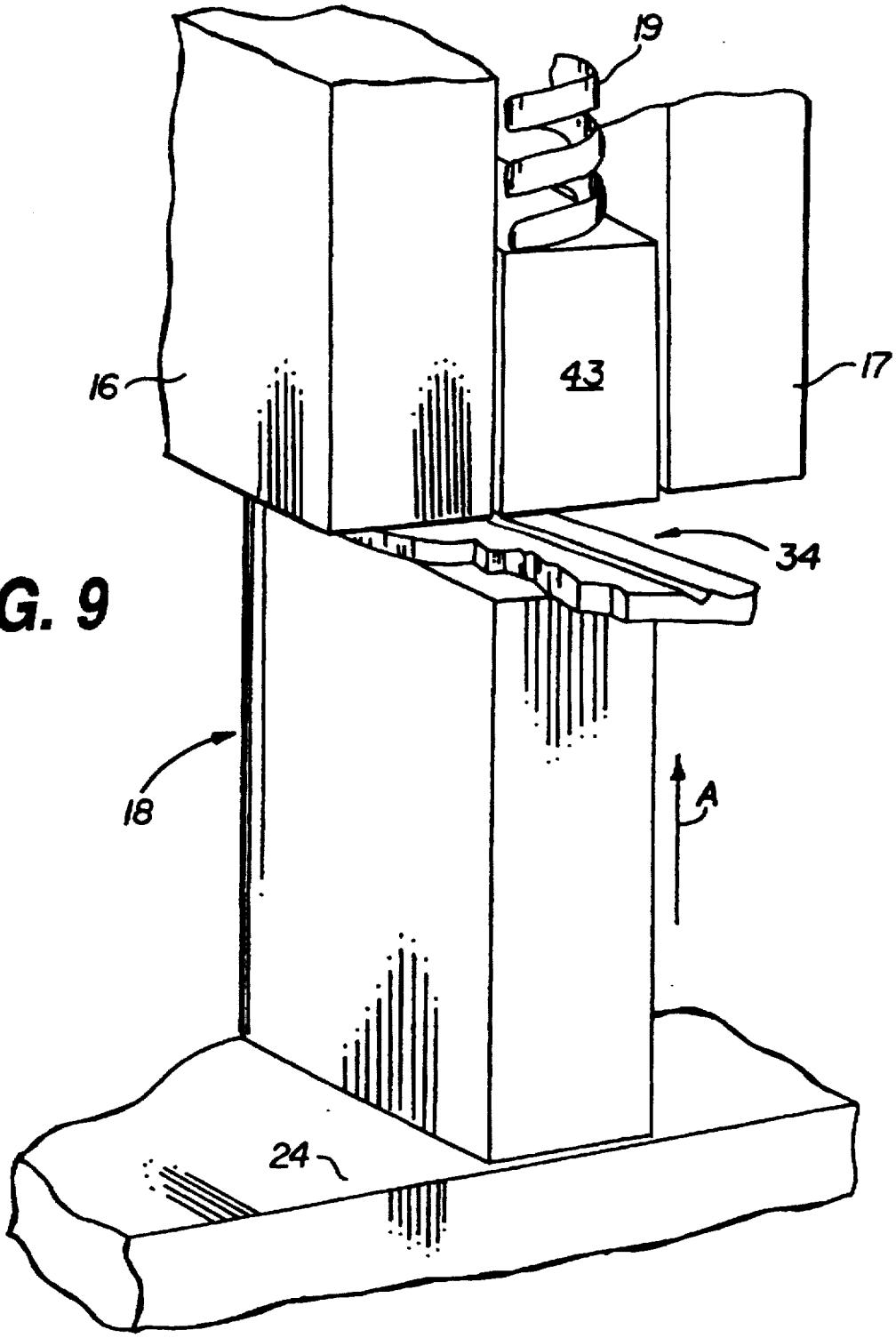
FIG. 9 is a perspective view of a portion of the hydraulic press assembly of FIG. 6 illustrating the mode of operation thereof.

The position of a key 34 on pedestal 18 just prior to the shearing of the head of the key is illustrated in FIGS. 8 and 9. The position of pedestal 18 in the shoe assembly (key positioner assembly) just prior to the shearing of the head of a key 24 is illustrated in FIG. 8. In FIG. 8, springs 37 of the shoe assembly have been compressed from their normal expanded state but have not yet been completely compressed. The pedestal 18 is U-shaped and includes an arcuate tip or head 26 which is slidably received by a comparably shaped opening 42 in the crown assembly. The movement of surface 41 into opening 42 functions to shear the head of the key to produce a reduced size key head 49A having the semi-oval shape illustrated in FIGS. 2 to 4. The nesting of pedestal 18 in die 40 prior to the shearing of the head of a key is also illustrated in FIG. 7.

After a key 34 is secured with the shoe assembly on pedestal 18 in the manner illustrated in FIG. 8, the jack 25 (FIG. 6) is operated to displace plates 23 and 24 in the direction of arrow A. Displacing plates 23, 24 in the direction of arrow A causes pedestal 18 and posts 14, 15 to be displaced in the direction of arrow A. When posts 14, 15 are displaced in the direction of arrow A, plate 13 remains fixed in position and springs 20 and 21, respectively, are compressed between plates 24 and 13. When pedestal 18 is displaced in the direction of arrow A, surface 41 is pressed through the head 35 of key 34 into opening 42 to shear head 35 and form a semi-oval key head having the shape of the head 49A in FIGS. 2 to 4. When surface 41 is pressed in the direction of arrow A into opening 42, member 43 is displaced in the direction of arrow A and compresses spring 19. After the key head 35 is sheared the hydraulic jack is released, springs 20, 21 and 42 cause plates 23 and 24, the shoe assembly, posts 14 and 15, pedestal 18, and member 43 to move downwardly in a direction opposite that of arrow A.

After keys have been blanked in accordance with the invention to produce a key 50A having a reduced size head 49A (FIGS. 2 and 4), attempting to turn the key in a lock by manually grasping and rotating the head 49A of the key is difficult because the reduced size of the head of the key makes it difficult to grasp the head of the key and to generate a rotational force of sufficient magnitude on the key. Consequently, the head or carrier 53 illustrated in FIG. 3 is utilized in conjunction with the head 49A a key 50A to facilitate the generation on the key of a torque having sufficient magnitude to turn the key in a lock.

FIGS. 10 to 12 also illustrate a substantially rigid carrier 70 used to store blanked keys 50A and to generate a torque on a key 50A. In FIG. 10, blanked keys are mounted on a post 76 by sliding the eyelet 52 of each key onto post 76 of fastener 74. As illustrated in FIGS. 11 and 12, the proximate end of cylindrical post 76 is fixedly attached to head 79 of fastener 74. Internally threaded aperture 77 is formed in the distal end of post 76. In order to install one or more blanked keys 50A on post 76, post 76 is slid through cylindrical aperture 80 and through eyelet 52 of a blanked key 73, 57, 56, and/or 50A. The internally threaded aperture 77 is then turned onto externally threaded member 78 such that fastener 74 is secured in the position shown in FIG. 10. Each blanked key carried on fastener 74 is rotatable through one hundred and eighty degrees from a storage and transport position over plate 72 (such as the storage and transport position of keys 50A, 56, 57 in FIG. 10) to an operative position extending outwardly away from, but substantially parallel to, plate 72 (such as the operative position of key 73 in FIG. 10). The toothed distal end of a key in the operative position is inserted into a lock in conventional fashion and rotated in one of the directions indicated by arrows N to open the lock.

Carrier 70 is presently fabricated from metal or rigid plastic and includes outwardly extending substantially rigid arms 71 and 75 integrally formed and affixed to plate 72. Aperture 80 is formed through arm 75. Member 78 is secured to arm 71. Carrier 70 functions to provide a means for storing and transporting blanked keys 56, 57, 50A and 73 and also, when grasped and turned, enables a user to readily generate on a blanked key in the operative position of key 73 a torque in the direction of arrows N to turn key 73 in a lock around the longitudinal axis L of the key. When carrier 70 is turned in the direction of arrows N, carrier 70 and the blanked keys 56, 57, 50A and 73 on the carrier simultaneously rotate in the direction in which carrier 70 is being turned.

The rigid carrier 81 illustrated in FIG. 13 includes a slot 82 which slidably removably receives the head 49A of a blanked key 50A such than when carrier 81 is manually grasped and rotated in the direction of arrows M about the longitudinal axis P of key 50A, key 50A rotates in direction M simultaneously with carrier 81. Carrier 81 also facilitates the generation of a torque force on a key 50A to rotate the key in the direction of arrows M about its longitudinal axis P when key 50A is being utilized to open a lock.

The width 83 of the portion of carrier 81 manually grasped, held, and rotated is greater—typically by at least a factor of two—than the width W of the head 49A of a blanked key. The width 84 of the portion of carrier 70 manually grasped, held, and mined is also typically at least twice that of the width W of head 49A. As can be seen in FIG. 3, the width of head 53 is also greater than the width W of head 49A. The width 83, 84 of a carrier 81 or 70, respectively, is a dimension perpendicular to the longitudinal axis L or P of a blanked key carried by the carrier 81 or 84. The width of head 53 is also a dimension perpendicular to the longitudinal axis of key 50A in FIG. 3.

The carrying case 85 illustrated in FIGS. 14 and 15 includes a pair of flaps 86, 87 attached along a hinge line 104. Each flap 86, 87 is presently preferably credit-card sized and is fabricated from a pliable material like plastic. Flaps 86 and 87 can, however, be sized as desired, be fabricated from any kind of material, be rigid or pliable, be of any desired shape and dimension, or otherwise be constructed as desired. Flap 87 includes a thin, rectangular plastic layer having a rectangular peripheral edge 88, a top rectangular surface 89, and a bottom rectangular surface 90. A generally rectangular piece of clear plastic 91 is attached to surface 89 along narrow heat sealed seams 92 to 98 to form pockets 99 to 102. The top of each pocket 99 to 102 is open along a portion of peripheral edge 103 that is spaced apart from and adjacent fold line 104. Seams 92 to 96 are parallel to one another. The bottom of each pocket 100 to 102 is sealed closed by seam 97. The bottom of pocket 99 is sealed closed by seam 98. The sides of each of each pocket 99 to 102 are sealed closed by a spaced apart pair of seams 92 to 96.

In FIG. 15, blanked key 73 is slid into and stored in pocket 99. The lower portion of key 73 contacts and is sandwiched between plastic 91 and surface 89. The top of key 73 extends out through the open top of pocket 99. Blanked key 57 is slid into and stored in pocket 100. The lower portion of key 57 contacts and is sandwiched between plastic 91 and surface 89. The top of key 57 extends out through the open top of pocket 100. Blanked key 56 is slid into and stored in pocket 101. The lower portion of key 56 contacts and is sandwiched between plastic 91 and surface 89. The top 107 of key 56 extends out through the open top of pocket 101. Torquing member 53 is slide into and stored in pocket 102. The lower portion of torquing member 53 contacts and is sandwiched between plastic 91 and surface 89. The top 106 of member 53 extends out through the open top of pocket 102. The shape and dimension of flaps 86 and 87 is substantially equivalent such that when flap 86 is folded along seam 104 onto and against flap 87 the peripheral edges 88 and 108 coterminate to form a credit card sized carrying case. The top of each of keys 73, 57, 56 and member 53 are readily manually grasped between the forefinger and thumb to slide each key 73, 57, 56 and member 53 from its respective pocket 99 to 102. Since carrying case 85 is preferably fabricated from soft, pliable plastic, it is readily concealed on the person and conform to the shape and contour of the user's body. Further, since case 85 is readily carried on the person or in a wallet, billfold, or purse, it is readily available for a person to use in the event one or more other keys corresponding to keys 73, 57, and/or 56 is lost by the user. Keys 73, 57, and/or 56 can correspond to one or more other blanked keys or unblanked keys which are ordinarily in the possession of the user.

Having described my invention in such terms as to enable those skilled in the art to understand and practice it, and having described the presently preferred embodiments thereof, I claim:

1. Apparatus for producing a blanked key from an existing key, said existing key including head having an inner portion and an outer portion, and an elongate neck having an edge and a tooth pattern formed along said edge, said blanked key including a reduced size head formed by removing material from said head of said existing key, and said elongate neck of said existing key, said apparatus including (a) a punch (18);

(b) a shoe for holding said existing key prior to displacement of at least said inner portion of said head of said existing key by said punch to shear material from said head, said shoe including (i) a first die (27) having a first groove (36) formed therethrough, (ii) a second die (40) including a second groove (39) formed therethrough, said second die being connected to said first die such that said first and second grooves are in alignment to permit said punch to pass through said first and second grooves, said second die including a third groove (31) shaped and dimensioned to receive said neck of said existing key, and means (32) for securing said head of said existing key such that said inner portion extends over said second groove; and, (c) means (25) for displacing said punch through said first and second U-shaped grooves to contact and displace said inner portion of said head of said existing key.

2. The apparatus of claim 1 including spring means (37) intermediate said first and second dies.

3. Apparatus for producing a blanked key from an existing key, said existing key including a head having an inner portion and an outer portion, and an elongate neck having an edge and a tooth pattern formed along said edge, said blanked key including, a reduced size head formed by removing material from said head of said existing key, and said elongate neck of said existing key, said apparatus including (a) a movable plate (23);

(b) a punch (18) mounted on said plate;

(c) a shoe (27,40) resting on said plate for holding said existing key prior to displacement of said existing key by said punch to shear material from said head;

(d) a stationary plate (11);

(e) a die (16,17) mounted on said stationary plate;

(f) an opening formed in said die to receive a portion of said head of said existing key;

(g) a key support member (43) in said opening;

(h) spring means (19) operatively associated with said key support member (43);

(i) means (25) to displace said movable plate (23) and said punch (18) from a first operative position toward said stationary plate (11) to a second operative position to force said inner portion of said head of said existing key into said opening to (i) displace said key support member (43) and compress said spring means (42), and (ii) shear said outer portion to form said reduced size head.

4. The apparatus of claim 3 wherein said shoe includes (a) a first die (27) having a first groove (36) formed therethrough;

(b) a second die (40) including a second groove (39) formed therethrough, said second die being connected to said first die such that said first and second grooves are in alignment to permit said punch (18) to pass through said first and second grooves, said second die including (i) a third groove (31) shaped and dimensioned to receive said neck of said existing key, and (ii) means (32) for securing said head of said existing key such that said inner portion extends over said second groove.

5. Apparatus for producing a blanked key from an existing key, said existing key including a head having an inner portion and an outer portion, and an elongate neck having an edge and a tooth pattern formed along said edge, said blanked key including a reduced size head formed by removing material from said head of said existing key, and said elongate neck of said existing key, said apparatus including (a) a movable plate (23);

(b) a punch (18) mounted on said plate;

(c) a shoe (27,40) resting on said plate for holding said existing key prior to displacement of said existing key by said punch to shear material from said head;

(d) a stationary plate (11);

(e) a die (16,17) mounted on said stationary plate;

(f) an opening formed in said die (16,17) to receive a portion of said head of said existing key;

(g) a key support member (43) in said opening;

(h) a spring (42) operatively associated with said key support member;

(i) means (25) to displace said movable plate and said punch from a first operative position toward said stationary plate to a second operative position such that said punch forces said inner portion of said head of said existing key into said opening to (i) displace said key support member (43) and compress said spring (42), and (ii) shear said outer portion to form said reduced size head.

6. The apparatus of claim 5 wherein the shoe includes (a) a first die (27) having a first groove (36) formed therethrough;

(b) a second die (40) including a second groove (39) formed therethrough, said second die being connected to said first die such that said first and second grooves are in alignment to permit said punch (18) to pass through said first and second grooves, said second die including (i) a third groove (31) shaped and dimensioned to receive said neck of said existing key, and (ii) means (32) for securing said head of said existing key such that said inner portion extends over said second groove.

7. The apparatus of claim 6 wherein said means for displacing said movable plate comprises a manually operated hydraulic pump (25) positioned underneath said movable plate (23).

8. The apparatus of claim 5 wherein said means for displacing said movable plate comprises a manually operated hydraulic pump (25) positioned underneath said movable plate (23).

9. The apparatus of claim 7 including a slide (29) for contacting and securing said elongate neck of said existing key in said third groove (31).

10. The apparatus of claim 9 including spring means (37) intermediate to first and second dies (27,40).

* * * * *